US011078573B2

(12) United States Patent
Lostak et al.

(10) Patent No.: US 11,078,573 B2
(45) **Date of Patent: *Aug. 3, 2021**

(54) METHOD FOR PRODUCING A STEEL PRODUCT WITH A ZN COATING AND A TRIBOLOGICALLY ACTIVE LAYER DEPOSITED ON THE COATING, AND A STEEL PRODUCT PRODUCED ACCORDING TO SAID METHOD

(71) Applicants: ThyssenKrupp Steel Europe AG, Duisburg (DE); thyssenkrupp AG, Essen (DE)

(72) Inventors: Thomas Lostak, Neukirchen-Vluyn (DE); Christian Timma, Duisburg (DE)

(73) Assignees: THYSSENKRUPP AG, Essen (DE); THYSSENKRUPP STEEL EUROPE AG, Duisburg (DE)

( * ) Notice: Subject to any disclaimer, the term of this patent is extended or adjusted under 35 U.S.C. 154(b) by 310 days.

This patent is subject to a terminal disclaimer.

(21) Appl. No.: 16/070,809

(22) PCT Filed: Jan. 19, 2016

(86) PCT No.: PCT/EP2016/050951

§ 371 (c)(1),
(2) Date: Jul. 18, 2018

(87) PCT Pub. No.: WO2017/125131

PCT Pub. Date: Jul. 27, 2017

(65) Prior Publication Data

US 2019/0024240 A1 Jan. 24, 2019

(51) Int. Cl.
*C23C 22/53* (2006.01)
*C23C 2/26* (2006.01)
(Continued)

(52) U.S. Cl.
CPC ..... *C23C 22/53* (2013.01); *C23C 2/26* (2013.01); *C23C 22/78* (2013.01); *C23C 2/06* (2013.01); *C23C 2/40* (2013.01)

(58) Field of Classification Search
CPC .... C23C 2/06; C23C 2/26; C23C 2/40; C23C 2/405; C23C 22/00; C23C 22/05;
(Continued)

(56) References Cited

U.S. PATENT DOCUMENTS 2,812,298 A * 11/1957 Hardoen ..... C25D 3/56
205/177
4,168,241 A 9/1979 Kozima et al.
(Continued)

FOREIGN PATENT DOCUMENTS

CN 1914354 A 2/2007
CN 104178757 A 12/2014
(Continued)

OTHER PUBLICATIONS

Langill, "Galvanized Steel Submerged in Water", 2000. American Galvanizers Association. (Year: 2000).*
(Continued)

*Primary Examiner* — Keith Walker
*Assistant Examiner* — Benjamin C Anderson
(74) *Attorney, Agent, or Firm* — The Webb Law Firm

(57) ABSTRACT

A process for producing a steel product having a protective coating based on zinc and a tribologically active layer applied to the protective coating where the process includes providing a flat steel product provided with the protective coating, and applying an aqueous solution comprising ammonium sulfate and demineralized water to the protective coating of the steel product. The concentration of the ammonium sulfate based on the $SO_4^{2-}$ ions is 0.01-5.7 mol/L, the pH of the aqueous solution is 4-6, and the near-surface
(Continued)

reaction time between the aqueous solution and the protective coating is more than 0 seconds and not more than 5 seconds. After a drying operation conducted without preceding rinsing, a tribologically active layer consisting of ammonium zinc sulfate is formed atop the protective zinc coating. Also, a steel product having a protective coating based on zinc and a tribologically active layer of ammonium zinc sulfate.

12 Claims, 3 Drawing Sheets

(51) Int. Cl.
*C23C 22/78* (2006.01)
*C23C 2/06* (2006.01)
*C23C 2/40* (2006.01)

(58) Field of Classification Search
CPC ..... C23C 22/06; C23C 22/48; C23C 22/50; C23C 22/53; C23C 22/78; B32B 2255/06
USPC ..... 148/240, 243, 270
See application file for complete search history.

(56) References Cited

U.S. PATENT DOCUMENTS

| | | | | |
|---|---|---|---|---|
| 6,194,357 | B1 | 2/2001 | Murata et al. | |
| 6,416,648 | B1 * | 7/2002 | Park | C25D 3/565 205/155 |
| 6,528,182 | B1 * | 3/2003 | Bello | C23C 22/68 148/246 |
| 10,072,229 | B2 * | 9/2018 | Lostak | C10M 103/06 |
| 2004/0005476 | A1 * | 1/2004 | Ando | C23C 22/73 428/659 |
| 2004/0255818 | A1 | 12/2004 | Pawloski | |
| 2008/0302267 | A1 * | 12/2008 | Defalco | C23C 18/00 106/1.23 |
| 2008/0308192 | A1 * | 12/2008 | Bello | C23C 22/68 148/246 |
| 2009/0084682 | A1 * | 4/2009 | McMillen | C23C 18/54 205/50 |
| 2010/0154673 | A1 * | 6/2010 | Defalco | C23C 22/08 106/1.23 |
| 2015/0093594 | A1 * | 4/2015 | Chaleix | C25D 11/34 428/639 |
| 2017/0009351 | A1 * | 1/2017 | Demeyere | C23C 22/361 |
| 2017/0260471 | A1 | 9/2017 | Lostak et al. | |

FOREIGN PATENT DOCUMENTS

| | | | | |
|---|---|---|---|---|
| CN | 104404498 | A | 3/2015 | |
| DE | 69906555 | T2 | 3/2004 | |
| EP | 2851452 | A1 | 3/2015 | |
| EP | 2995674 | A1 | 3/2016 | |
| GB | 739313 | | 10/1955 | |
| JP | 200979262 | A | 4/2009 | |
| WO | 2005071140 | A1 | 8/2005 | |
| WO | 2015197430 | A1 | 12/2015 | |
| WO | WO-2015197430 | A1 * | 12/2015 | C23C 22/78 |

OTHER PUBLICATIONS

Adhesives—Designation of main failure patterns, German version EN ISO 10365:1995.
Adhesives—Determination of peel resistance of adhesive bonds—Floating roller method, German version EN 1464:2010.
Adhesives—Determination of tensile lap-shear strength of bonded assemblies, German version EN 1465:2009.
Cachet et al., EIS investigation of zinc dissolution in aerated sulphate medium Part II: zinc coatings, Electrochimica Acta, 2002, pp. 3409-3422, vol. 47.
Kijima et al., Skin-pass rolling I—Studies on roughness transfer and elongation under pure normal loading, International Journal of Machine Tools & Manufacture, 2008, pp. 1313-1317, vol. 48.
Kijima et al., Skin-pass rolling II—Studies of roughness transfer under combined normal and tengential loading, International Journal of Machine Tools & Manufacture, 2008, pp. 1308-1312, vol. 48.
Lobnig et al., Atmospheric Corrosion of Zinc in the Presence of Ammonium Sulfate Particles, J. Electrochem. Soc., May 1996, pp. 1539-1546, vol. 43, No. 5.
Meuthen et al., Coil Coating—Bandbeschichtung: Verfahren, Produkte and Märkte [Coil Coating: Processes, Products and Markets] Vieweg & Sohn Verlag/GWV Fachverlage GmbH, 1st edition 2005, ISBN: 3-528-03975-2.

* cited by examiner

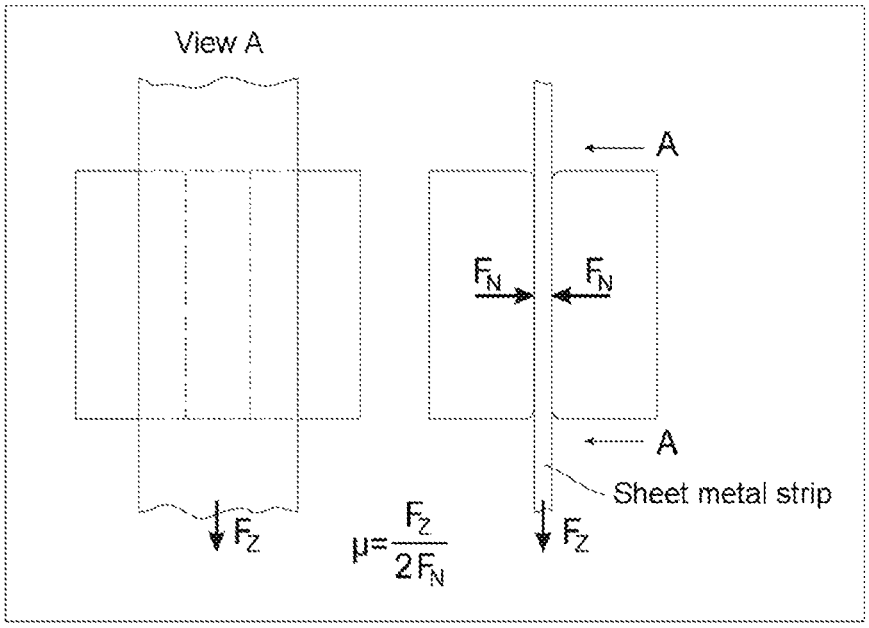
Fig. 3 Schematic construction of the strip-drawing testbed
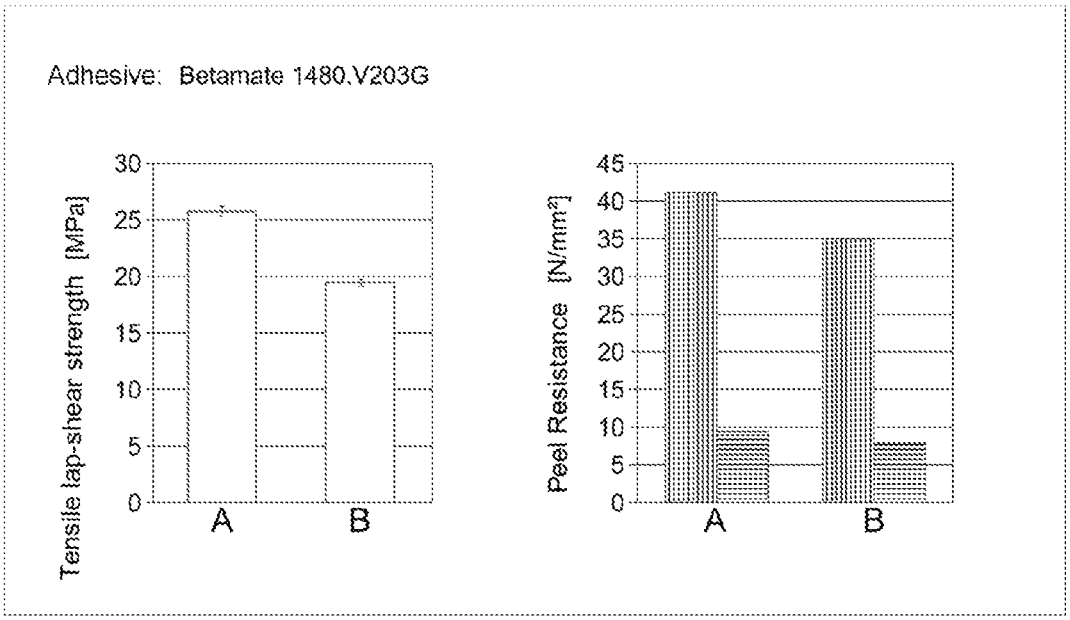
Fig. 4 Representation of tensile lap-shear strength (MPa) and peel resistance (N/mm). (A) uncoated reference provided with a protective Zn coating only and (B) $(NH_4)_2Zn(SO_4)_2$ layer (dry applied coat weight 20 mgS/m²) on a Zn coating

METHOD FOR PRODUCING A STEEL PRODUCT WITH A ZN COATING AND A TRIBOLOGICALLY ACTIVE LAYER DEPOSITED ON THE COATING, AND A STEEL PRODUCT PRODUCED ACCORDING TO SAID METHOD

CROSS-REFERENCE TO RELATED APPLICATION

This application is the United States national phase of International Application No. PCT/EP2016/050951 filed Jan. 19, 2016, the disclosure of which is hereby incorporated in its entirety by reference.

BACKGROUND OF THE INVENTION

Field of the Invention

The invention relates to a process for producing a steel product having a protective coating based on zinc and a tribologically active layer applied to the protective coating.

The invention likewise relates to a steel product provided with such a layer structure, where this steel product is especially a flat steel product.

Where the present text refers to "flat steel products", this means rolled products in the form of a strip, sheet or of (precut) blanks obtained therefrom. The term "fine sheet" refers here to flat steel products having a sheet thickness of typically up to 3 mm.

Description of Related Art

To optimize their surface properties, galvanized flat steel products, after galvanization, typically undergo skin pass rolling in which they are formed with low degrees of forming. The skin pass rolling imparts a texture to the respective flat steel product, which increases the roughness of the substrate and, as a result, improves the adhesion and appearance of the organic coatings applied subsequently. Furthermore, the skin pass rolling operation is known to have positive effects on the mechanical properties of the flat steel product. More detailed information on the skin pass rolling process and the effects thereof on a modern fine sheet can be found in the publications entitled "Skin-pass rolling I—Studies on roughness transfer and elongation under pure normal loading" and "Skin-pass rolling II—Studies of roughness transfer under combined normal and tangential loading", written by Hideo Kijima and Niels Bay, published in "International Journal of Machine Tools & Manufacture", Part 148 (2008) 1313-1317 & Part 11 48 (2008) 1308-1312.

Hot dip-galvanized flat steel products are increasingly replacing electrolytically galvanized flat steel products in the field of automobile bodywork construction.

Irrespective of how the Zn coating is applied, the respective flat steel product to be formed or an already preformed steel component, for the forming operation to give a component, is inserted into a forming machine and then formed by the machine to give the respective component. The forming may be conducted in the form of cold forming, i.e. as a forming operation at temperatures below the recrystallization temperature of the respective steel of the flat steel products, or in the form of hot forming, i.e. in the form of forming at working temperatures above the recrystallization temperature.

A typical example of such a forming operation is thermoforming, in which the flat steel product to be formed is pressed into a die by means of a ram. The form of the die and ram here determine the form that the flat steel product takes on as a result of the forming operation.

In every forming operation, there are relative movements between the forming mold used for the forming in each case and the product to be formed. At the same time, there is contact between the surfaces of the product and the faces of the forming tool assigned to them. The tribological system that arises between the mold and the product to be formed is determined by the material properties of the product to be formed and the mold, and by the media present between the product to be formed and the mold. The relative movement between the forming mold and the product to be formed in contact with the forming mold gives rise to friction.

This friction may be locally very different particularly in the forming of flat steel products because the material of the flat steel product is differently formed in sections in the course of the forming, and hence the material of the flat steel product likewise flows at locally very different rates in the course of forming. Therefore, specifically in the case of production of components of complex shape by thermoforming or comparable cold forming operations in which generally high degrees of forming are achieved and complex shapes are formed, there are dynamically varying states of friction in which static friction and dynamic friction can occur in alternation.

These frictional forces that occur especially in the course of cold forming may be so high that they disrupt the continuous course of the shaping operation and can cause incorrect shaping of the component to be formed in each case. At the same time, the friction that unavoidably occurs results in considerable wear to the mold.

Particularly critical products in this connection have been found to be flat steel products where a zinc-based protective coating that provides protection from corrosion or other environmental effects has been applied to the actual flat steel product.

In order to optimize the tribological properties of electrolytically galvanized fine sheet for forming processes that are typical for automobiles, a phosphate layer is typically formed atop the Zn coating. In conventional tricationic phosphating, the Zn-coated base substrate is typically attacked by pickling, in which metal cations at first go into solution with evolution of hydrogen. In the next process step, owing to the change in pH, sparingly soluble phosphates precipitate out close to the surface and form a firmly adhering conversion layer.

Modern phosphating operations are among what are called layer-forming phosphating operations. The layer is formed therein by metal cations from the phosphation solution (e.g. zinc, manganese). Owing to the acidic pickling process, however, cations from the base substrate can also be incorporated into the phosphate layer.

The good sliding properties of the phosphate layer are based partly on the ease with which the phosphate crystals can be sheared away. As well as the tribological aspect, the phosphation improves the corrosion protection of the electrolytically galvanized fine sheet. For processing-related reasons, however, phosphation of hot dip-galvanized flat steel products on a production line is not economically implementable.

The phosphate layer applied in the phosphation process which is typical for automobiles is not among the conventional dry lubricants (for example graphite, $MoS_2$). The lubricating action of the phosphate layer is based on the effect that there is interaction of the anticorrosion oils or pre-lubes that have been applied to the flat steel products for supplementary protection with the phosphate layer and the hot dip-galvanized substrate beneath.

Subsequently, fine sheets coated in such a way are contacted with an anticorrosion oil or a pre-lube in order to guarantee sufficient corrosion protection during transport and subsequent storage. Moreover, the oiling assures additional preliminary lubrication in the forming operation.

From an ecological point of view, conventional tricationic phosphating is regarded at least as critical since the disposal of the process media (phosphates sludges, wastewaters) obtained is complex. High energy costs also occur in the phosphating operation since the process baths work at elevated temperatures.

EP 2 851 452 A1 discloses that carbonate-based conversion layers improve the tribological properties of galvanized fine sheet. The carbonate source is selected, for example, from ammonium hydrogencarbonate, ammonium carbonate etc., and a hydroxide source is selected from alkali metal hydroxides, alkali metal oxides etc. This layer is applied in accordance with the invention by means of a chemcoater. The coat weight of the dry substance is 25 to 200 mg/m$^2$. The pH of the aqueous solution of the invention is preferably in the region of 9 t 0.5. Owing to the basic medium, specific technical and personal protective measures (e.g. protective gloves, protective glasses) have to be taken.

DE 699 06 555 T2 describes a coating consisting of zinc hydroxysulfate. For this purpose, a galvanized steel substrate is coated with an aqueous solution containing a sulfate ion concentration of more than 0.07 mol/L. The layer thus applied is partly water-insoluble and improves the tribological properties of the coated fine sheet. Example 7 of this publication describes the relationship between the water-insoluble and water-soluble component of the zinc hydroxysulfate formed. It is apparent from this example that the improvement in the lubricating effect is brought by the water-insoluble component. Furthermore, it is stated that the proportion of the water-insoluble component increases with rising coating time. It can therefore be assumed that the preliminary lubrication of the layer applied increases with coating times of >20 seconds. However, owing to the water-insoluble component of the zinc hydroxysulfate layer, particular demands (e.g. high/low pH values) are made on the automobile manufacturers' inline cleaning baths, which can be economically and ecologically disadvantageous.

U.S. Pat. No. 6,194,357 B1 discloses the use of various emulsions that improve the cold forming of metals. These emulsions consist of the following components: (A) water-soluble inorganic salt (e.g. borax, potassium tetraborate, sodium sulfate etc.), (B) solid lubricant (e.g. sheet silicates, metal soaps etc.), (C) natural (e.g. mineral oil etc.) and synthetic oils, (D) surfactant and (E) water. The ratio between (B) and (A) is in the range from 0.05:1 up to 2:1. The ratio between (C) and (B)+(A) is between 0.05:1 and 1:1. The dry coat weight of the coating described is specified within a range between 1 and 50 g/m$^2$. The layer of the invention displays its positive tribological properties on metals only by means of all the components ((A)-(E)) specified. Individual components of the layer of the invention, for example potassium tetraborate, are classified as being hazardous to health.

Additionally described from U.S. Pat. No. 4,168,241 is a solid lubricant based on a sulfate (calcium or barium sulfate), an already known lubricant from the group of graphite, graphite fluoride, molybdenum disulfide etc. and an organic lubricant (e.g. fatty acids, metal soaps etc.). The solid sulfate-based lubricant displays its desired effect when the particle size is <100 μm. This requires a comparatively complex production process. The dry coat weight of this coating is in the range of 5-15 g/m$^2$.

GB 739,313 additionally discloses an oxalate-containing coating which is said to improve the tribological properties of the metallic substrate coated therewith. The improved tribological properties of the coating are attributed to the iron oxalate present. However, iron oxalate is harmful to health.

US 2004/0255818 A1 describes a coating based on aluminum sulfate and aluminum sulfate precursors, boric acid and boric acid precursors, and polycarboxylate and polycarboxylate precursors. The coat weights applied here are 0.2 to 1.2 g/ft$^2$. The improvement in the shaping characteristics is achieved merely via the interaction of the components mentioned. However, boric acid is now classified as particularly damaging to the environment.

SUMMARY OF THE INVENTION

Against the background of the above-elucidated prior art, the problem has arisen of naming a process which permits, with simple products that are of no concern with regard to environmental pollution, production of a tribologically optimal coating on a galvanized surface of a steel product.

A steel product having, as well as optimized corrosion protection, optimal suitability for forming to a component, especially to a bodywork component, was likewise to be specified.

The process of the invention for production of a steel product having a protective coating based on zinc and a tribologically active layer applied to the protective coating accordingly comprises:

applying an aqueous solution comprising ammonium sulfate and demineralized water to the protective coating of the steel product, wherein the concentration of the ammonium sulfate based on the $S4^2$ ions is 0.01-5.7 mol/L, wherein the pH of the aqueous solution is 4-6 and wherein the near-surface reaction time between the aqueous solution and the protective coating is more than 0 seconds and not more than 5 seconds, such that, after a drying operation conducted without preceding rinsing, there is a tribologically active layer consisting of ammonium zinc sulfate atop the protective coating.

The invention thus envisages, in a no-rinse process (i.e. in a process in which a rinsing operation after the application of the aqueous solution consisting of ammonium sulfate and demineralized water to the protective coating is dispensed with), applying an aqueous solution consisting of ammonium sulfate and demineralized water to the protective Zn coating of the steel product processed in each case.

The concentration of the ammonium sulfate based on the total volume here is in the range of 0.01-5.7 mol/L.

For the application of the solution to be applied in accordance with the invention to the Zn coating, it is possible to use a conventional chemcoater or coil-coater. Chemcoaters or coil-coaters of this kind are described, for example, in the book "Coil Coating—Bandbeschichtung: Verfahren, Produkte and Markte" [Coil Coating: Processes, Products and Markets] by P. Meuthen, Almuth-Sigrun Jandel, Friedr. Vieweg & Sohn Verlag/GWV Fachverlage GmbH, 1st edition 2005, ISBN: 3-528-03975-2. This involves applying the aqueous solution at least to one side of the zinc alloy coating of the steel substrate. Alternatively, it is also possible to apply the aqueous solution by means of spraying, in which case the spraying is followed by squeezing-off in order to adjust the thickness of the film formed from the solution that remains on the respective substrate. This procedure is typically employed in coating systems through which the respective steel product passes in a continuous run.

The dry coat weight of the tribologically active layer produced in accordance with the invention, and accordingly present atop a steel product of the invention, is typically 1-100 mg/m$^2$ based on the sulfur content, and particularly favorable dry coat weights, especially with regard to suitability for welding, have been found to be dry coat weights of not more than 20 mg/m$^2$, especially of 10-20 mg/m$^2$, based in each case on the S content of the coating. Dry coat thicknesses of practical relevance are 10-15 mg/m$^2$, likewise based on the S content.

A further interfacial chemistry characteristic of the tribologically active layer produced in accordance with the invention is that the double sulfate $(NH_4)_2Zn(SO_4)_2$, owing to the mixed Zn crystal formed, exhibits high adhesion to the zinc alloy coating.

The tribologically active coating applied in accordance with the invention simultaneously offers exceptionally high lubricity, especially in cold forming processes that are typical for automobiles, and is thus of optimal suitability for forming to give a component in a forming mold. Studies have shown that the tribologically active layer produced in accordance with the invention does not impair the subsequent processes that are typical for the production of automobile bodywork parts, such as bonding, welding, phosphating or electrophoretic coating. Flat steel products coated in accordance with the invention, by comparison with merely oiled fine sheets, have distinctly improved tribological properties. Moreover, the coating generated and created in accordance with the invention offers excellent compatibility with subsequent processes in the manufacturing process which is typical of automobiles (joining, phosphatability, cathodic electrocoatability etc.).

The tribologically active layer provided and produced in accordance with the invention is additionally readily removable with water, for example, if any effect on the subsequent processes thereby is to be reliably ruled out.

Owing to its chemical composition, the ammonium zinc sulfate coating produced and provided in accordance with the invention on a steel product is extremely environmentally friendly and of very little concern to health.

The invention relies on the findings already described in a general form in European patent application 14 18 44 15.9, which was yet to be published at the priority date of the present application, but additionally gives information about the parameters such as, more particularly, the reaction time between the applied aqueous solution containing ammonium sulfate as per the invention and the respective steel substrate, which is crucial in order to obtain the constitution of the tribologically active layer which has been recognized as favorable in accordance with the invention. The content of European patent application 14 18 44 15.9 is therefore incorporated by reference into the present patent application for elucidation of the technical relationships in which the invention is involved, and the possible practical implementation of the process of the invention.

The steel substrates that are to be provided for the process of the invention and form the basis of the steel products formed in accordance with the invention are coated for protection from corrosion with a protective coating based on zinc. The Zn-based coating can be applied in a conventional manner as a pure zinc layer or as a zinc alloy layer and, for improvement or adjustment of its properties, have contents of Mg, Al, Fe or Si. Alloy specifications that describe typical compositions of such Zn-based coatings that provide protection from corrosion and have been found to be useful in practice are, for example, 0.5-5% by weight of aluminum and/or up to 5% by weight of magnesium, the balance being zinc and unavoidable impurities. For coating with such a Zn coating, for example, a flat steel product, after a pretreatment conducted in a conventional manner, can be cooled to the respective bath entry temperature and then passed through an iron-saturated Zn melt bath containing, as well as the main zinc constituent and unavoidable impurities, 0.05-5% by weight of Al and/or up to 5% by weight of Mg at 420-520° C. within a dipping time of 0.1-10 s.

The protective Zn coating of the steel product provided in accordance with the invention may have been applied electrolytically, for example. However, it has been found to be particularly advantageous from a practical and economic point of view when the protective Zn coating has been applied to the respective steel substrate of the flat steel product by hot dip coating by employing processes that are likewise known per se.

The respective steel substrate of the flat steel product to be coated by the process of the invention may have any composition known from the prior art, provided that it permits coating with a Zn-based protective coating and is suitable for the respective subsequent process. Typical examples of steels of which the steel substrate of flat steel products coated in accordance with the invention consists are IF steels, microalloyed steels, bake-hardened steels, TRIP steels, dual-phase steels and deep-drawing steels, such as the steels known, for example, by the DX51D to DX58D designation (material numbers 1.0226, 1.0350, 1.0355, 1.0306, 1.0309, 1.0322, 10.0853).

The aqueous solution applied in accordance with the invention to the Zn-based protective coating does not comprise any additional constituents aside from the main "demineralized water" and "ammonium sulfate" components. More particularly, the presence of other organic components, especially those that could be a matter of concern from an environmental point of view, is ruled out.

The concentration of the ammonium sulfate in the aqueous solution, based on the $SO_4^{2-}$ ions, is chosen within the range of 0.01-5.7 mol/L such that the coating consisting of the double sulfate $(NH_4)_2Zn(S4)_2$ that has been provided in accordance with the invention is reliably formed atop the Zn coating. From this point of view, it may be appropriate when the concentration of the ammonium sulfate based on the $SO_4^{2-}$ ions is 0.1-3 mol/L. Particularly in this case, and especially when the concentration of the ammonium sulfate based on the $SO_4^{2-}$ ions is 0.4-0.7 mol/L, the optimal pH needed for the coat formation of the invention is innately established without further addition of acids or bases, without any need to add further auxiliaries for adjustment of the pH of the solution. Furthermore, this concentration range is optimal from an environmental and economic point of view, since only the amount of ammonium sulfate needed to form an ammonium zinc sulfate layer of the invention on galvanized fine sheet under the application conditions described is used.

In order to achieve formation of the coating for improvement of the forming properties of the fine sheet, the pH of the solution used is between 4 and 6, and the tribologically active $(NH_4)_2Zn(SO_4)_2$ layer envisaged in accordance with the invention is established in a particularly operationally reliable manner especially when the pH of the aqueous solution is 4.2-5.7.

Table 1 shows the relationship between the pH and the ammonium zinc sulfate layer formed in accordance with the invention.

The invention is effective irrespective of the particular composition of the protective coating, provided that the basis for the protective coating is zinc, i.e. zinc is the predominant constituent of the protective coating. For the experiments reported here, a hot dip-galvanized fine sheet was used.

A prerequisite for the formation of the double sulfate (ammonium zinc sulfate) which is the aim of the invention is the pickling reaction, i.e. the dissolution of zinc as a result of the reaction between the solution applied in accordance with the invention and the surface of the protective Zn layer wetted with the solution. The invention is based here on the finding that the pickling process proceeds only at acidic pH values, i.e. at pH values of less than 7.

As described above, the pH established in the solution is dependent on the concentration of the ammonium sulfate and has to be within the range defined in accordance with the invention. If the ammonium sulfate concentration of the solution is too low, the pH of the solution for the reaction that is the aim of the invention will be too high, the Zn in the coating will not dissolve and no ammonium zinc sulfate will form.

In order to be able to attain the high pH values not in accordance with the invention that are reported in table 1, a base (e.g. NaOH) was additionally added to the respective solution. In solutions having such high pH values, all that takes place is passivation of the Zn coating, and ammonium sulfate forms on the surface or the dissolved ammonium sulfate dries out. However, the ammonium zinc sulfate to be formed in accordance with the invention does not form.

The coating temperature is of no importance in the application of the solution.

For the experiments for which the results are compiled in table 1, the following solutions have been prepared:

pH: 4.6: 0.7 mol/L ammonium sulfate dissolved in demineralized water pH: 5.1: 0.1 mol/L ammonium sulfate dissolved in demineralized water pH: 8.8-9.6: 0.7 mol/L ammonium sulfate dissolved in demineralized water+base (e.g. NaOH)

TABLE 1

Relationship between the pH of the application solution and the $(NH_4)_2Zn(SO_4)_2$ layer formed

| pH | $(NH_4)_2Zn(SO_4)_2$ layer formation |
|---|---|
| 4.6 | yes (inventive) |
| 5.1 | yes (inventive) |
| 8.8 | no (noninventive) |
| 9.1 | no (noninventive) |
| 9.6 | no (noninventive) |

With the aqueous solution as per the invention, applied in a no-rinse method, it can be ensured that the zinc dissolution process required for the formation of the $(NH_4)_2Zn(SO_4)_2$ layer provided in accordance with the invention as the tribologically active layer proceeds reliably at the interface between the protective Zn coating and the aqueous solution.

The near-surface reaction time between the aqueous solution and the protective coating present atop the steel substrate of the respective steel product is of particular significance according to the findings of the invention. For instance, the near-surface reaction after the application of the aqueous solution, according to the invention, has to last for a sufficiently long period to enable the formation of the double sulfate $(NH_4)_2Zn(SO_4)_2$ on the Zn coating. However, the reaction time must not last for too long either, since the result is otherwise formation of unwanted, sparingly soluble zinc sulfate. These two conditions are complied with when, as specified by the invention, the near-surface reaction time is more than 0.1 second, but not more than 5 seconds. In the case of reaction times of longer than 5 s, the first fractions of unwanted zinc sulfate are formed. Even small amounts of zinc sulfate impair subsequent process compatibility, for example the suitability of the coating for adhesion.

The reaction time can be controlled via the time span between the application of the respective solution to the protective Zn coating and the drying of the solution. Using the example of a coating system through which a steel product passes in a continuous run, this means that the reaction time available is defined by the production line application process. For example, the length of the application zone in which the solution is applied to the respective steel product by spraying with subsequent squeezing-off is 2-3 m, and this application zone is passed through at a belt speed of 2-3 m/s; thus, the application time and the associated reaction time is about 1 s. Directly downstream of the application zone, the steel product then enters a drier that dries the remaining wet film formed from solution at a temperature of 70-90° C. The drying ends the reaction.

The situation is similar in a chemcoater or coil-coater application when the wet film is dried by means of a drier directly downstream of the coater in that case too.

In order to show that, in the case of compliance with the reaction times defined in accordance with the invention between the applied ammonium sulfate solution and the galvanized fine sheet, the ammonium zinc sulfate layer provided in accordance with the invention is reliably established, a steel substrate which has been hot dip-galvanized with a protective Zn coating containing 1% by weight of aluminum, the balance being zinc and unavoidable impurities, has been dipped into an ammonium sulfate solution having an ammonium sulfate concentration based on the $SO^{2-}$ ions of 0.1 mol/L and an associated pH of 5.1. This coating operation was effected at room temperature.

In parallel, by means of confocal Raman spectroscopy, the coating that formed was examined continuously. The intensity of the $v_1$-$ZnSO_4$ vibration band at 962 wavenumbers served here as a direct measure for the formation of the unwanted zinc sulfate.

The results can be found in table 2.

TABLE 2

Proportion of $ZnSO_4$ formed as a function of reaction time

| Reaction time [s] | Proportion of the $ZnSO_4$ vibration band (962 $cm^{-1}$) [%] |
|---|---|
| 0 | 0 (inventive) |
| 5 | 0 (inventive) |
| 6 | 5 (noninventive) |
| 10 | 12 (noninventive) |
| 30 | 32 (noninventive) |
| 60 | 58 (noninventive) |
| 90 | 91 (noninventive) |
| 180 | 100 (noninventive) |
| 300 | 100 (noninventive) |

X-ray diffractometry is a suitable analytical method for characterization of the ammonium zinc sulfate layer applied in accordance with the invention. FIG. 1 shows the x-ray diffractogram of an ammonium zinc sulfate layer produced in accordance with the invention on a hot dip-galvanized steel substrate. The x-ray diffractogram shows typical reflections of a layer of ammonium zinc sulfate and was confirmed with reference spectra. With the application parameters of the invention, no zinc sulfate was formed.

In addition, confocal Raman spectroscopy is particularly suitable as a vibration spectroscopy method for characterization of ultrathin coatings. FIG. 2 shows the Raman spectrum of an ammonium zinc sulfate layer produced in accordance with the invention.

To produce the tribologically active layer envisaged in accordance with the invention, the solids-free aqueous solution having a composition in accordance with the specifications of the invention can be applied to at least one side of the galvanized steel sheet by means of a chemcoater or coil-coater or any other method suitable for the purpose. There is then a chemical reaction between the ammonium sulfate, which is fully dissociated in the solution, and the zinc surface. As can be inferred in the articles by R. E. Lobnig et al. "Atmospheric corrosion of zinc in the presence of Ammonium sulfate particles", published in Journal of the Electrochemical Society 143 (1996) pp. 1539-1546, and by C. Cachet et al. "EIS investigation of zinc dissolution in aerated sulphate medium—Part II: zinc coatings", published in Electrochimica Acta 47 (2002) pp. 3409-3422, there is at first dissolution of the oxidized zinc coating or of the metallic zinc ($ZnO+2H_3O^+ \rightarrow Zn^{2+}+3\ H_2O$; $2\ Zn+8\ NH_4^+ + O_2 \rightarrow 2\ Zn(NH_3)_4^{2+}+2H_2O+4H^+$). Acidic dissolution of the galvanized base substrate is followed by layer formation of the tribologically active substance, consisting of ammonium zinc sulfate ($4\ Zn(NH_3)_4^{2+}+2\ (NH_4)_2SO_4+6\ H_2O \rightarrow (NH_4)_2Zn(SO_4)_2 \times 6\ H_2O+6\ NH_3+2\ H^+$).

The ammonium zinc sulfate formed in accordance with the invention is a specific double sulfate. This double sulfate is crucial for the improved tribological properties and for the subsequent process compatibility typical for automobiles. Studies have shown that, by the process of the invention, it is possible to produce such a layer in an operationally reliable manner suitable for manufacture on the industrial scale.

The ammonium zinc sulfate layer produced in accordance with the invention is water-soluble and in this aspect does not place any particular demands on the cleaning processes as typically conducted particularly in the manufacture of automobile bodywork and the like after the shaping of the steel product and before further processing thereof. The tribologically active layer formed in accordance with the invention can thus be easily removed, for example prior to a phosphation process and a subsequent cathodic electrocoating application.

The formation of the ammonium zinc sulfate layer of the invention as a tribologically active layer can easily be verified by means of x-ray diffractometry and Raman spectroscopy. A characterizing feature of the tribologically active layer produced in accordance with the invention is that it consists entirely of the double sulfate ammonium zinc sulfate and that it is free of sparingly soluble zinc hydroxysulfate.

It will be apparent in this connection that the terms "completely", "exclusively", "free of" and the like that are used here in connection with the formation of the tribologically active layer of the invention should each be understood in the technical sense; for example, even in the case of a tribologically active layer formed in accordance with the invention and consisting "completely" or "exclusively" of ammonium zinc sulfate, it may be the case that other technically unavoidable constituents are present therein, but these have no influence on the effect of this layer.

After the aqueous solution has been applied, it can be dried under air at ambient temperatures. In industrial scale use, however, it may be appropriate to accelerate the process by forcing the drying in an oven, especially a tunnel oven. For this purpose, the respective steel product can be kept in the respective oven at a temperature of 70-90° C. over a period of 1-3 s.

Irrespective of how the drying is conducted, the ammonium zinc sulfate layer of the invention is formed. The coat weight of the dry substance based on the sulfur content per $m^2$ is 0.1-100 $mg/m^2$, preferably 10-50 $mg/m^2$, and particularly useful coat weights based on the sulfur content have been found to be 10-20 $mg/m^2$. The "sulfur content per square meter" reported in milligrams is also referred to in the present text as "$mgS/m^2$" for short.

The process of the invention for production of the double sulfate atop the surface of the hot dip-galvanized fine sheet does not require any special safety measures since ammonium sulfate is not a hazardous substance.

The application of the tribologically active layer provided in accordance with the invention can be incorporated without any problem into a conventional hot-dip coating plant corresponding to the current state of the art.

An example of a suitable method of controlling the layer thickness of the ammonium zinc sulfate layer provided and produced in accordance with the invention is the method of x-ray fluorescence analysis, which is known for this purpose. This process is based on the use of x-radiation for material characterization. This involves knocking near-nucleus electrons out of inner shells of the atom. As a result, electrons from higher energy levels can fall back into the ground state. The energy released is characteristic of the respective element. Sulfur is evaluated as identification element for the layer applied in accordance with the invention. No addition of further trace elements is necessary.

In addition, the tribologically active layer can be analyzed by means of glow discharge spectroscopy, which is likewise known. In this process, the metallic workpiece is connected as the cathode and eroded with argon ions. The atoms eroded are excited in the plasma and emit photons of characteristic wavelength.

In principle, it is possible to treat preformed steel products intended for ready-forming one by one in the manner of the invention in order to assure optimal conditions for the ready-forming operation. However, the invention is found to be particularly advantageous when the steel product to be processed in accordance with the invention is a flat steel product. In the case of flat steel products of this kind, the steps to be conducted in accordance with the invention can be incorporated into a coating system passed through continuously, which enables particularly economically viable implementation of the process of the invention on the industrial scale. This is especially true when the flat steel product of the invention is a steel strip.

After the respective coating process, an anticorrosion oil or a pre-lube can be applied in a manner known per se to the steel product that has been coated in accordance with the invention and dried, in order to prevent surface corrosion on the transport route to the respective forming installation and to further improve the forming characteristics in the forming.

In order to ensure optimal adhesion of the coating composition provided for use in accordance with the invention on the respective surface, the surface in question can be subjected to alkaline cleaning prior to the application of the coating composition. In the case of processing in a continuous run, in which the process of the invention is conducted immediately after a zinc coating operation, it is possible to dispense with alkaline cleaning. In that case, the coating is applied directly after the galvanization.

BRIEF DESCRIPTION OF THE DRAWINGS

The invention is elucidated in detail hereinafter by working examples. The figures show:

FIG. 3 a schematic of an experimental setup for a strip-drawing test from a partial front view and a side view where A indicates a top surface of the sample;

FIG. 4 a diagram that shows the tensile lap-shear strength and peel resistance of a solely Zn-coated reference sample and a sample covered in accordance with the invention with an ammonium zinc sulfate layer.

DESCRIPTION OF THE INVENTION

Figure 1:
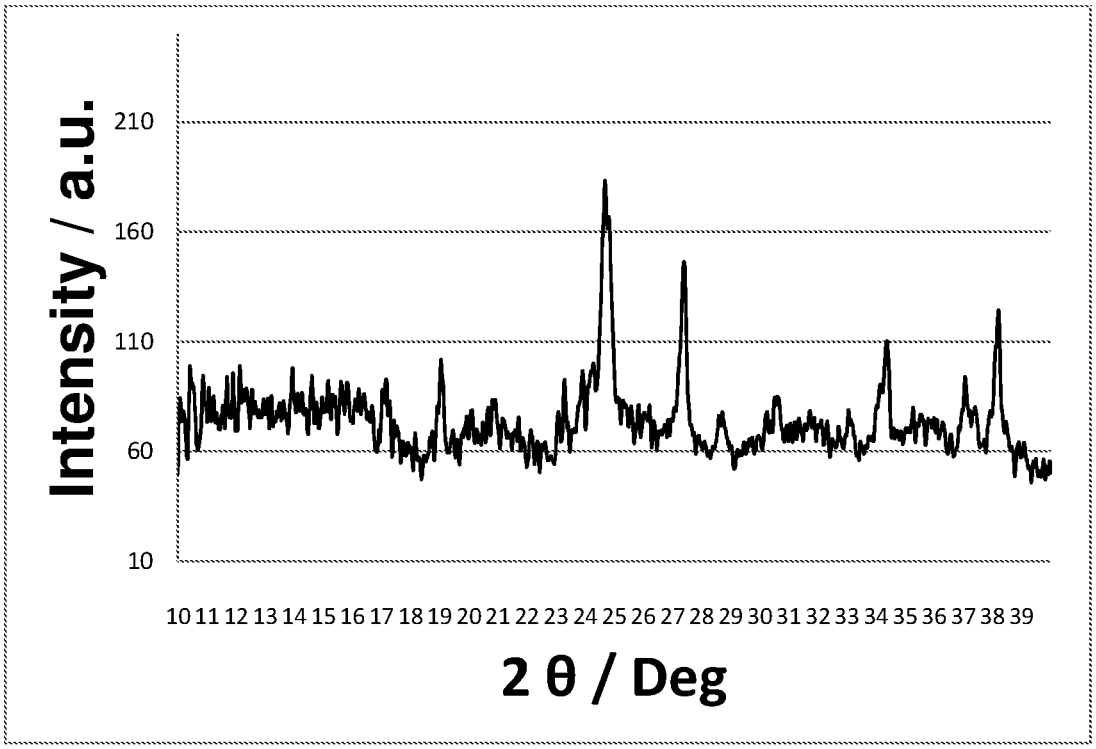
FIG. 1 a diffractogram of an $(NH_4)_2Zn(SO_4)_2$ layer which has been applied in accordance with the invention to a flat steel product provided with a Zn coating produced by hot-dip galvanization.
Figure 2:
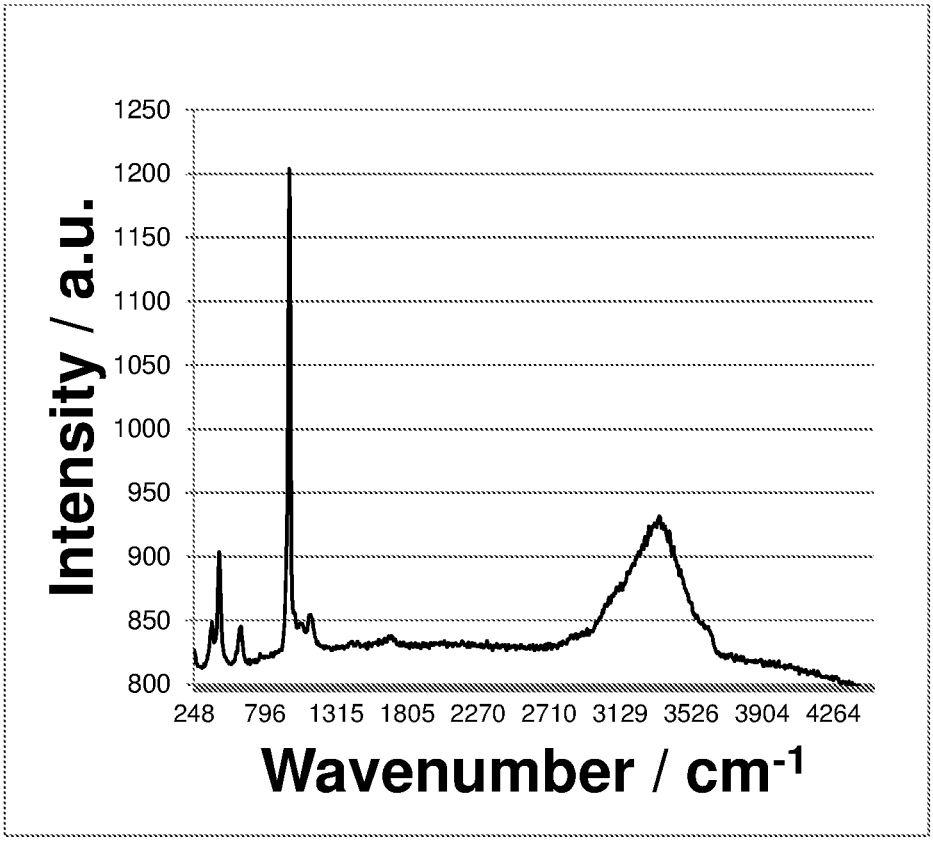
FIG. 2 a Raman spectrum of an $(NH_4)_2Zn(SO_4)_2$ layer which has been applied in accordance with the invention to a flat steel product provided with a Zn coating produced by hot-dip galvanization.

The efficacy of the invention was tested using series of experiments that have been conducted a) under laboratory conditions and b) on the industrial scale on a coating line.

First of all, in a general form, the common features of the experiments and the test methods employed in the respective case for verification of the experimental results are elucidated hereinafter. There then follows a description of the experimental conditions specifically employed in the experiments in each case and of the experimental results obtained in specific terms.

For the coating experiments, an of a typical of automobiles under the DX51D name known (materials number 1.0226) consisting cold-rolled steel strip was used, which has been coated by conventional hot-dip galvanization with a 7 μm zinc layer that consisted of 1% by weight of aluminum, the balance being Zn and technically unavoidable impurities.

An application solution that consisted of ammonium sulfate dissolved in demineralized water (conductivity <0.05 μS/cm) was applied to the steel substrate coated in this way with Zn. The ammonium sulfate was completely in solution. No further substances were added. The application solution was consequently a completely aqueous, solids-free solution.

After the aqueous solution has been applied to the Zn-coated flat steel product samples, the samples have been dried.

Subsequently, the samples thus coated in accordance with the invention have been used to conduct various tests in order to verify the effect of the ammonium zinc sulfate layer produced in accordance with the invention.

The friction characteristics of the flat steel product samples coated in the manner of the invention with a tribologically active ammonium zinc sulfate layer have been determined using a strip-drawing test system. The strip-drawing experiment conducted with this system gives a significant simplification of the friction conditions at the binder during a deep-drawing forming operation.

The termination criterion for the strip-drawing test is the occurrence of the stick-slip effect. This effect refers to the sticking and slipping of solids moved against one another. The result is a rapid sequence of sticking, stretching, separating and slipping mechanisms between the surfaces in relative movement and occurs in the event of inadequate separation of the surfaces (for example by a lubricant). The experimental setup is shown in schematic form in FIG. 3. Prior to commencement of the strip-drawing experiment, the substrate coated in the manner of the invention is oiled with a pre-lube. In the experiments, the pre-lube supplied under the Anticorit PL 3802-39S trade name by FUCHS Europe Schmierstoffe GmbH, for example, was used (see catalogue "Schmierstoffe für die Anbau- and Außenhautteile im automotiven Bereich" [Lubricants for Installable and Outer Skin Parts in the Automotive Sector], bloesch-partner.de 07/2008 1.0). The oil application rate was 1.5 g/m$^2$. The sample geometry of the coated flat steel products was 700×50 mm$^2$, while the mold area was 660 mm$^2$. The sample was pulled through the mold area at a speed of 60 mm/min. The areal pressure, $F_N$, rose from 1 MPa to 100 MPa in a linear manner over the entire test region. The measurement distance was 500 mm. The result of the examination of the strip-drawing experiment is represented as a function of the friction value p based on the areal pressure [MPa], $F_N$, and the force, $F_Z$, required to pull the sample through the mold area.

In order to be able to assess the effect on the bonding characteristics of a bodyshell, T-peel tests were conducted according to DIN EN 1465-2009. For this purpose, an adhesive supplied under the Betamate 1480.V203 trade name by Dow Automotive was used.

The fracture area and the fracture type were then assessed visually according to the method of EN ISO 10365:1995. The fracture took place either in the adhesive itself or in the material of the part that has been joined. In the case of fractures within the adhesive, a distinction was made between a cohesion fracture in which the separation takes place in the adhesive, and an adhesion fracture in which the fracture takes place at the interface between the part that has been joined and the adhesive. It was additionally possible for the material of the sample itself to fail while the adhesive remains intact. A differentiation was made here between fracture of a part that has been joined and fracture through delamination.

Subsequently, in welding experiments, the suitability for welding of the flat steel products coated in accordance with the invention in the manner elucidated was examined. For this purpose, resistance point welds were conducted, for which, in addition to the assessment of the electrode lifetime, the welding current range of two flat steel products lying one on top of the other was assessed. In the case of the electrode lifetime, what was examined was how many weld points can be produced with an electrode pair without going below the weld point diameter of 3.6 mm. The diameter here was examined after 100 points had been produced. The specifications with regard to the electrode lifetime are dependent on the manufacturer. However, at least 400 weld points should be achievable with one electrode pair since redressing of the electrodes is then necessary.

In addition, a sufficiently large welding range is of essential significance in the automobile industry with regard to the suitability of the material for welding. It is necessary that this range is at least 1 kA in size. The lower limit results from the minimum lens diameter, the upper limit from spattering.

a) Experiment Under Laboratory Conditions

An aqueous coating solution was produced. For this purpose, 92.5 g of ammonium sulfate were dissolved in 1 liter of demineralized water. No particular measures were taken here to adjust the pH of the coating solution; instead, the innate pH of the solution was used, which was about 5. More particularly, no bases or acids were added to adjust the pH.

The hot dip-galvanized flat steel product samples were subjected to alkaline cleaning before the application of the coating.

The treatment solution was distributed homogeneously by means of a conventional coil-coater on the hot dip-galvanized sheet.

This was followed by the drying of the wet film applied in a tunnel oven at a drying temperature of 50-90° C.

By appropriate adjustment of the coil-coater, the amount of aqueous coating solution applied was adjusted such that the dry coat weight of the $(NH_4)_2Zn(SO_4)_2$ layer obtained on the samples corresponded to the provisions of the invention.

The coat weight applied in mgS/m$^2$ was measured by means of mobile x-ray fluorescence analysis (RFA).

Before the strip-drawing test, the test samples were coated with the pre-lube (Anticorit PL 3802-39S). The oil application rate was 1.5 g/m$^2$.

In order to represent the correlation between the dry coat weight applied in mgS/m$^2$ and the resulting coefficient of friction as a function of areal pressure in MPa, various dry coat weights were applied by means of the coater and tested by means of the strip-drawing test.

Table 3 summarizes the results of these experiments. It is clearly apparent that the forming performance is significantly improved with rising coat weight.

TABLE 3

Occurrence of the stick-slip effect according to the dry $(NH_4)_2Zn(SO_4)_2$ coat weight (laboratory application)

| Coat weight [mgS/m$^2$] | Area pressure before the stick-slip effect occurs [MPa] |
|---|---|
| 0 | 2 |
| 10 | 35 |
| 20 | >100 |
| 30 | >100 |

b) Experiment Under Industrial Conditions (Production Line Application)

First of all, a coating solution having a concentration of 51 g/L ammonium sulfate in demineralized water was prepared. Left unchanged, the innate pH of the aqueous solution obtained was about 5.

The aqueous ammonium sulfate solution was applied by means of an application unit arranged inline downstream of a conventional hot dip galvanization plant in which the solution was sprayed onto the galvanized flat steel product and then squeezed off in a manner known per se to establish the layer thickness.

The drying was effected in a tunnel oven at 80° C.

The coat weight applied in mgS/m$^2$ was measured by means of mobile x-ray fluorescence analysis (RFA).

The flat steel product samples coated in the manner of the invention that were obtained were oiled at an oiling rate of about 1 g/m$^2$ with a thixotropic, barium-free anticorrosion oil supplied under the RP4107S trade name by FUCHS Europe Schmierstoffe GmbH.

The friction-reducing effect of the ammonium zinc sulfate layer produced in accordance with the invention was characterized by means of the strip-drawing test.

Table 4 states the areal pressure attained in MPa before the stick-slip effect occurred and the test had to be stopped. Here too, a significant improvement in the tribological properties of the ammonium zinc sulfate-coated substrates was found.

TABLE 4

Occurrence of the stick-slip effect depending on the $(NH_4)_2Zn(SO_4)_2$ coat weight (production line application)

| Coat weight [mgS/m$^2$] | Areal pressure before the stick-slip effect occurs [MPa] |
|---|---|
| 0 | 7 |
| 20 | 65 |
| 25 | >100 |
| 36 | >100 |
| 70 | >100 |

As well as the forming-promoting properties of the tribological coating, the subsequent process compatibility of such a coating plays an important role for the employability of such coatings in the automotive sector.

Therefore, the T-peel test already elucidated in general terms above was conducted on the flat steel product samples obtained in the manner described above in order to verify adhesive compatibility in the case of use of conventional structural adhesives.

FIG. 4 shows the tensile lap-shear strength and peel resistance of an uncoated reference (Z) and an ammonium zinc sulfate layer of the invention with a coat weight of 20 mg S/m$^2$.

The reduction in the tensile lap-shear strength and in the peel resistance compared to the uncoated reference is acceptable and surprisingly does not restrict the use of this coating in the field of automobile bodywork. Moreover, the fracture type close to the substrate is cohesive.

Welding tests according to Stahl-Eisen-Prüfblatt [Steel and Iron Test Sheet] 1220-2 showed that the resistance point welding of sheets coated in accordance with the invention was not impaired by the ammonium zinc sulfate layer applied in accordance with the invention when the dry coat weight did not exceed 25 mg S/m$^2$, especially 20 mg S/m$^2$. In the case of coat weights of more than 25 mg S/m$^2$, there was increased surface spattering in the case of the flat steel product samples coated in accordance with the invention that were examined, which would make it difficult to use them in the automotive sector. On compliance with dry coat weights in the range of 10-15 mg S/m$^2$, both the welding range $\Delta I$ ascertained according to Stahl-Eisen-Prüfblatt 1220-2 and the electrode lifetime were sufficiently high. Table 5 summarizes the suitability of the flat steel product samples produced in the experiment and coated in accordance with the invention for various subsequent processes.

A dry applied coat weight of, for example, 100 mgS/m$^2$ would have a severe adverse effect on resistance point welding and subsequent bonding. However, phosphation would not be a problem and would still be unproblematic since there are multiple rinsing and cleaning cascades just before the phosphation and the ammonium zinc sulfate layer of the invention is removed as a result.

TABLE 5

Suitability of the fine sheets coated in accordance with the invention for various subsequent processes typical of automobiles

| Coat weight | Suitability for | | |
|---|---|---|---|
| [mg S/m$^2$] | resistance point welding | bonding | phosphation |
| 10 | very good | very good | very good |
| 20 | very good | very good | very good |
| 30 | moderate | moderate | very good |
| 40 | poor | poor | good |
| 80 | very poor | very poor | good |
| 100 | very poor | very poor | good |

In order to represent the suitability for adhesion of the ammonium zinc sulfate layer on a hot dip-galvanized fine steel sheet (99% by weight of zinc, 1% by weight of aluminum) by comparison with a zinc sulfate layer on a hot dip-galvanized fine steel sheet (99% by weight of zinc, 1% by weight of aluminum), a T-peel test in accordance with DIN EN 1464-2010 was conducted with the Elastosol M 105 adhesive (Bostik GmbH) at a test temperature of 130° C. The fracture area and fracture type were then assessed visually by the method of EN ISO 10365:1995. The advantageous properties of the ammonium zinc sulfate coating are clearly manifested here by comparison with a zinc sulfate coating:

TABLE 6

Assessment of the fracture area after T-peel test in accordance with DIN EN 1464-2010 at a test temperature of 130° C. Variant 1 is a hot dip-galvanized fine steel sheet (99% zinc, 1% aluminum) coated with ammonium zinc sulfate at a dry applied coat weight of 20 mg S/m$^2$. Variant 2 is a hot dip-galvanized fine steel sheet (99% zinc, 1% aluminum) coated with zinc sulfate at a dry applied coat weight of 20 mg S/m$^2$.

| Variant | Unbonded region (visually assessed according to EN ISO 10365: 1995) |
|---|---|
| 1 | <1% |
| 2 | >80% |

The invention claimed is:

1. A process for producing a steel product having a protective coating based on zinc and a tribologically active layer applied to the protective coating, comprising the following steps:

providing a steel product provided with the protective coating;

applying an aqueous solution comprising ammonium sulfate and demineralized water to the protective coating of the steel product;

wherein the concentration of the ammonium sulfate based on the $SO_4^{2-}$ ions is 0.01-5.7 mol/L, wherein the pH of the aqueous solution is 4-6, and wherein the near-surface reaction time between the aqueous solution and the protective coating is more than 0 seconds and not more than 5 seconds, such that, after a drying operation conducted without preceding rinsing, there is a tribologically active layer consisting of ammonium zinc sulfate atop the protective coating.

2. The process as claimed in claim 1, wherein the concentration of the ammonium sulfate in the aqueous solution based on the $SO_4^{2-}$ ions is 0.1-3 mol/L.

3. The process as claimed in claim 2, wherein the concentration of the ammonium sulfate in the aqueous solution based on the $SO_4^{2-}$ ions is 0.4-0.7 mol/L.

4. The process as claimed in claim 1, wherein the pH of the aqueous solution is 4.2-5.7.

5. The process as claimed in claim 1, wherein the steel product is a flat steel product.

6. The process as claimed in claim 1, wherein the aqueous solution is applied to the protective coating by a chemcoater or coil coater.

7. The process as claimed in claim 1, wherein the steel product, after the aqueous solution has been applied, is dried at a temperature of 70-90° C.

8. The process as claimed in claim 1, wherein the surface of the steel product to be coated is subjected to alkaline cleaning prior to the coating operation.

9. A steel product comprising a steel substrate and a protective coating based on zinc borne by the steel substrate, wherein a tribologically active layer consisting of ammonium zinc sulfate has been formed atop the protective coating.

10. The steel product as claimed in claim 9, wherein the dry coat weight of the tribologically active layer is 1-100 mg/m$^2$ based on the sulfur content.

11. The steel product as claimed in claim 10, wherein the dry coat weight of the tribologically active layer is 10-50 mg/m$^2$ based on the sulfur content.

12. The steel product as claimed in claim 11, wherein the dry coat weight of the tribologically active layer is 10-20 mg/m$^2$ based on the sulfur content.

* * * * *